United States Patent [19]

Czech

[11] Patent Number: 4,796,786

[45] Date of Patent: Jan. 10, 1989

[54] DISPENSER FOR PASTE-LIKE PRODUCTS

[76] Inventor: Joachim Czech, Jahnstrabe 19, D-8405 Donaustauf, Fed. Rep. of Germany

[21] Appl. No.: 47,570

[22] Filed: Apr. 22, 1987

Related U.S. Application Data

[63] Continuation of Ser. No. 738,537, May 24, 1985, abandoned, which is a continuation-in-part of Ser. No. 563,392, Nov. 14, 1983, abandoned.

[30] Foreign Application Priority Data

Jun. 15, 1982 [DE] Fed. Rep. of Germany ..... 3222492

[51] Int. Cl.[4] ..... B67D 5/40

[52] U.S. Cl. ..... 222/256; 222/327

[58] Field of Search ..... 222/207, 251, 256, 325–327, 222/336, 340–341, 372, 380, 383, 386, 389, 391

[56] References Cited

U.S. PATENT DOCUMENTS

| | | | |
|---|---|---|---|
| 1,964,866 | 7/1934 | Watson | 222/256 |
| 1,976,903 | 10/1934 | Tear | 222/256 |
| 2,025,232 | 12/1935 | Dodge | 222/256 X |
| 2,063,410 | 12/1936 | Tear | 222/327 |
| 2,471,852 | 5/1949 | Bau | 222/326 |
| 2,506,204 | 5/1950 | Freestone | 206/56 |
| 2,899,112 | 8/1959 | Morton | 222/325 |
| 3,231,147 | 1/1966 | Leahy | 222/262 |
| 3,268,123 | 8/1966 | Spatz | 222/400.5 |
| 3,752,366 | 8/1973 | Lawrence, Jr. | 222/209 |
| 4,301,948 | 11/1981 | Czech et al. | 222/341 |
| 4,402,431 | 9/1983 | Wiegner et al. | 222/327 |

FOREIGN PATENT DOCUMENTS

| | | |
|---|---|---|
| 0048419 | 3/1982 | European Pat. Off. . |
| 0051790 | 5/1982 | European Pat. Off. . |
| 1210149 | 2/1966 | Fed. Rep. of Germany . |
| 2901717 | 7/1980 | Fed. Rep. of Germany . |
| 2229625 | 12/1974 | France . |
| 2344469 | 10/1977 | France . |
| 2083142 | 3/1982 | United Kingdom . |

*Primary Examiner*—Michael S. Huppert

*Attorney, Agent, or Firm*—James E. Nilles; Thomas F. Kirby

[57] ABSTRACT

A dispenser for paste-like products consists of a dispensing head (1) and a cartridge (2) containing the paste-like product. The cartridge has its lower end closed by a follower piston slideable along the interior wall surface of the cartridge under action of the exterior atmosphere. In the dispensing head, a pumping device with a pump chamber is provided. An inlet-check valve is provided for prevention of backflow of paste-like material entering the pump chamber through a passage from the interior of the cartridge. At least one part of the inlet-check valve, for instance, a valve seat thereof or, for instance, all parts of the inlet-check valve, namely, a valve seat and a closure member, are provided on an upper cover wall of the cartridge as part of the cartridge. The cartridge is releasably connectable to the dispensing head. After exhaustion of its contents, the cartridge may be detached from the dispensing head and replaced by a filled cartridge. The dispensing head may be optionally provided with a dummy envelope adapted to surroundingly receive cartridges of different shape and/or volume connected to the dispensing head.

16 Claims, 3 Drawing Sheets

DISPENSER FOR PASTE-LIKE PRODUCTS

Figure 1:
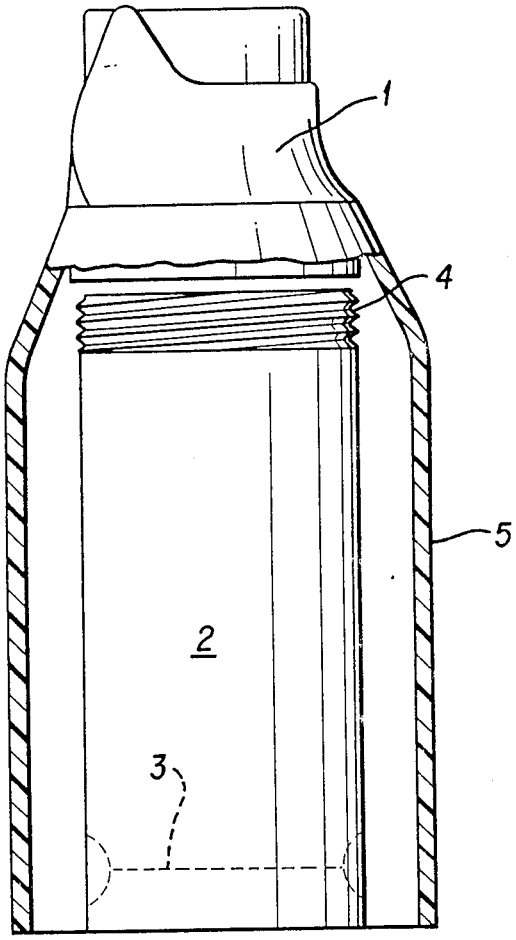

This application is a continuation of application Ser. No. 738,537, filed May 24, 1985 (abandoned) which is a continuation-in-part of application Ser. No. 563,392, filed Nov. 14, 1983, now abandoned.

The present invention relates to a dispenser for paste-like products with a dispensing head which includes a pumping device with a pump chamber, the volume of which may be varied by means of an actuation device actuable from outside, and with an inlet-check valve for prevention of backflow of paste-like material entering the pump chamber and with an outlet passage leading to a dispensing mouth and designed to prevent backflow of the paste-like material into the pump chamber, and with a substantially cylindric container containing the product to be dispensed, said container being formed as a replaceable cartridge releasably connected to the lower end of said dispensing head, said cartridge releasably connectable to the lower end of said dispensing head, said cartridge having its lower end closed by a follower piston slideable along the interior wall surface of the cartridge under the action of the exterior atmosphere.

In dispensers known in the art, e.g. in a dispenser as disclosed in DE-OS No. 29 01 717, the container filled with the product to be dispensed and the dispensing head are connected to one another by non-releasable connection means. The known dispensers are therefore sold as an integral unit which is then discarded bodily after the contents of the container have been consumed. It is obvious that this constitutes a considerable disadvantage from an economical point of view, since on the one hand, considerable amounts of suitable plastic material are required and consumed, and on the other hand, the disposal of the emptied dispensers causes considerable expenses and environment pollution. From the viewpoint of the user, a considerable disadvantage of the known dispensers consists in that he has to purchase a new dispensing head with the purchase of each new dispenser, such dispensing head being considerably expensive due to the delivery device, valve arrangement and actuating means included therein.

A dispenser is known from U.S. Pat. No. 4,402,431 (Wiegner et al), the container of which is not designed as a replaceable cartridge., but is irremovably connected to a dispenser head.

From U.S. Pat. No. 2,063,410 (Tear), a grease dispenser of the type described at the outset is known. In this known dispenser the pump chamber communicates with the interior of the cartridge container and with an outlet channel, respectively, via an inlet-check valve and an outlet-check valve, both formed as ball valves. The cartridge-like container is releasable from the dispenser head and is attachable thereto by thread connection means.

In the dispenser according to U.S. Pat. No. 2,063,410, the inlet-check valve is arranged in the dispenser head and does not form a part of the cartridge. In said known dispenser, all parts are made of metal. The manufacture and assembly of the dispenser head and the container of said known dispenser are thus complicated and costly. The known dispenser is not suited for mass-production of very large numbers of such dispensers at extremely low costs, and thus cannot be utilized as a dispenser for consumer products by end consumers in diverse applications. The known grease dispenser is limited in its applicability to a very specific technical field and thus to relatively small production numbers.

From U.S. Pat. Nos. 1,976,903 (Tear) and 3,231,147 (Leahy), a grease dispenser is known, respectively, in which there is no inlet-check valve provided between the pump chamber and the interior of the container. In this case, the grease to be dispensed is partly pressed back from the pump chamber into the container until the piston more or less blocks off the connecting channel between the container and the pump chamber. Finally, only one size of cartridge can be connected with the dispensing head.

From U.S. Pat. Nos. 2,899,112 (Morton) and from 2,506,204 (Freestone), grease dispensers are known, respectively, with a replaceable cartridge provided with a follower piston. In the top of the cartridge of each of said known dispensers, a passage for communication with the dispenser head of the respective dispenser is provided. However, there are no check valve means or parts thereof provided in the respective cartridges. Thus, all valve means necessary for warranting a pumping action must be given in the respective dispenser heads. A detailed description of the dispenser heads is not given in the respective aforementioned references of art.

It is therefore an object of the present invention to improve a dispenser of the type known from U.S. Pat. No. 2,063,410 in such a manner that a low cost mass-production is possible and that it is lightweight and physiologically acceptable and may thus be used and applied in various fields of application for dispensing a great variety of pasty materials.

In a dispenser for paste-like products of the type set forth in the generic clause of claim 1, this object is attained in that at least one part of the inlet-check valve consisting of a valve seat and a closure member is provided on an upper cover wall of the cartridge, and in that the cartridge and the pump chamber and the inlet check-valve as well as least parts of the actuation device are made of plastic.

In the dispenser according to the present invention, at least most of the parts may be made of plastic. This allows for a highly economical low cost mass-production, for instance, by extrusion molding and leads to a lightweight and hygienic dispenser which can be used in various fields of daily life, for instance, for dispensing foodstuffs or cosmetic material or cleaning material. The dispenser according to the present invention may be devised such that all parts of the inlet-check valve are provided in the cartridge container. Alternatively, the dispenser according to the present invention may also be devised such that at least a part of the inlet-check valve is provided in a cover wall of the cartridge container. For instance, a valve seat may be provided in the cover wall of the cartridge, said valve seat cooperating with a closure member provided in the dispenser head, once the cartridge is attached to the dispenser head. In this way, a particularly simple design is reached, which again allows for economical mass-production and easy assembly. This design is especially suited also for mass-production by extrusion molding of plastic, particularly if the parts of the valve, namely, valve seat and closure member are integral with the container and a part of the dispenser head, respectively, and thus can be manufactured together with a respective part of the dispenser.

The dispenser according to the present invention has the essential advantage that a dispensing head intended for use over an extended period may be sold as an independent unit, to be releasably connected to filled containers in the form of replaceable cartridges. After a cartridge of this type has been emptied it may be readily replaced by a new cartridge.

The advantage obtainable by use of the invention results in the first place from the fact that a plurality of container cartridges filled with a paste-like product may successively be brought into use by the employ of only a single dispensing head. After the contents of such a container-cartridge have been used up, the emptied cartridge is simply detached from the dispensing head and discarded, whereupon a new container-cartridge may be connected to the dispensing head.

In an alternative embodiment of the invention, an outlet-check valve is provided in the outlet passage. The presence of a physical outlet-check valve will warrant a positive prevention of backflow of material to be dispensed, irrespective of the properties of the material and the geometry of the outlet passage.

A particularly effective dispensing action is achieved in an advantageous embodiment of the invention characterized in that the pump chamber is cylindrical and oriented parallel to the axis of the container, and that the actuation device has a piston slideably guided in the cylindrical pump chamber and movable by means of an actuation member.

A further advantageous development of the afore-discussed embodiment of the invention is achieved in that the cylindrical pump chamber is open at its lower end and abuts the the cover wall of the container with said lower end and circumferes or surrounds the inlet-check in connected position of the cartridge and the dispenser head.

Advantageously, the dispenser according to the invention is designed such that the inlet-check valve has a plate-like closure member. In this case, the valve seat provided in the cover wall of the cartridge may be of a very simple shape to provide a contacting abutting rim for the plate around a communication passage in the cover wall. This allows for a very economical manufacture of the cartridge by extrusion molding in a mold of simple configuration.

In accordance with a further advantageous embodiment of the invention, the dispensing head is adapted to have cartridges of different shape and/or volume connected thereto, so that one and the same dispensing head may be used for a great number of cartridge of varying configuration and with varying volumes, whereby the production costs for manufacturing the dispenser head are considerably reduced.

According to a still further advantageous embodiment of the invention, the dispensing head is formed with a dummy envelope surrounding the cartridge, said dummy envelope remaining always connected to the dispensing head and being optionally provided with a decorative outer surface.

Figure 3:
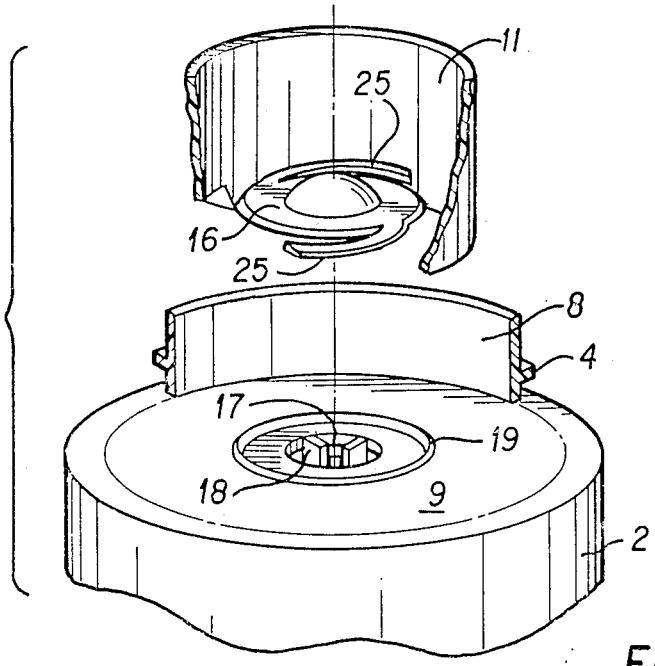

In the following, two exemplary embodiments of the invention shall be described with reference to the accompanying drawing. In the drawing FIG. 1 shows a partly sectioned diagrammatic view of a first embodiment of a dispenser according to the invention consisting of a dispensing head and a cartridge releasably connected thereto, FIG. 2 shows a sectional view along the longitudinal axis of a second embodiment of a dispenser according to the invention, and FIG. 3 shows an "exploded" view of the plate-like closure member of the inlet-check valve of the embodiment of the dispenser shown in FIG. 2, and of the co-operating valve seat at the cover wall of a cartridge.

Figure 2:
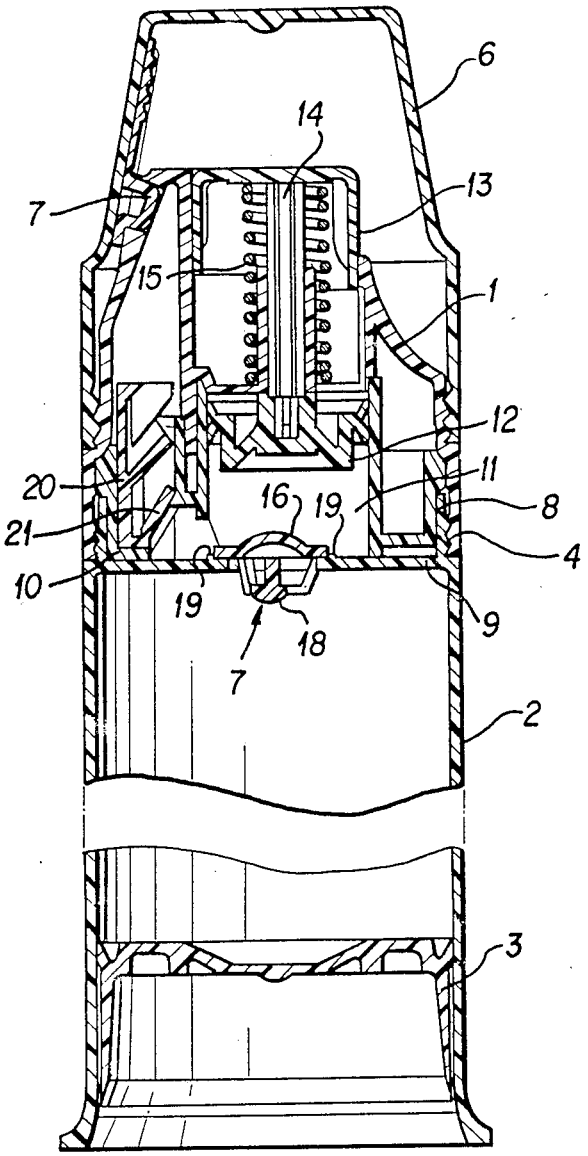

With reference to FIG. 1, a dispensing head generally designated by the numeral 1 comprises in a per se known manner a pump chamber, the volume of which is adapted to be varied by an exteriorly exerted pressure, and communicating with the interior of the container through a one-way inlet-check valve. This inlet-check valve permits a certain volume of the paste-like product to escape from the container to be dispensed to the exterior through a delivery device. For actuating the dispensing head, the volume of the pump chamber is reduced by manual pressure, whereby the product contained in the pump chamber is delivered or dispensed to the exterior of the device. During this reduction of the pump chamber volume the inlet-check valve remains closed.

The lower end of dispensing head 1 and the upper end of a replaceable cartridge generally indicated at 2 are releasably connected to one another by releaseable connection means, such as screw threads, so that the emptied cartridge may be readily detached from the dispensing head and replaced by a new, i.e. filled cartridge. The screw-thread connection means may of course be replaced by a bayonet-type connection means or the like.

The lower end of cartridge 2 is closed by a follower piston 3 sealingly sliding along the interior wall surface of the cartridge under the action thereon of the exterior atmosphere, so that dispensing of the product from the dispenser results in a reduction of the interior volume of the cartridge in such a manner that there is no vacuum developed therein, and air is prevented from accumulating in the cartridge, while the outer shape thereof remains unchanged. Follower piston 3 may be provided with suitable trip elements permitting it to only move upwards within cartridge 2 while preventing it from moving downwards therein.

In the embodiment of the dispenser according to the invention as shown in FIG. 1, all parts of the inlet-check valve may be provided in the top portion of the cartridge 2. In another advantageous alternative embodiment of the dispenser shown in FIG. 1, the valve closure member (not shown) may be provided in the dispensing head 1, whereas the valve seat co-operating with the closure member is formed on the top wall of the cartridge and is brought in an appropriate position for cooperation with the closure member once the cartridge is properly attached to the dispensing head.

In the embodiment shown diagrammatically in FIG. 1, cartridge 2 is of substantially the same diameter as dispensing head 1. It is to be understood, however, that cartridges of different diameters and different volumes may of course be connected to dispensing head 1, as long as the respective parts of the connection means 4 are properly fitted to each other.

As shown in FIG. 1, dispensing head 1 may be provided with a dummy envelope 5 surrounding cartridge 2, in which case envelope 5 would have to be dimensioned such that even the largest cartridges 2 intended for use with dispensing head 1 can be received therein The dummy envelope may be formed in one piece with the dispensing head and may optionally be provided with decorations.

In FIGS. 2 and 3, a second embodiment of a dispenser according to the invention is shown. In as far as parts of the dispenser shown in FIGS. 2 and 3 correspond with parts of the dispenser shown in FIG. 1, identical reference numerals are used. FIG. 2 shows a longitudinal section through a dispenser according to the invention with a conical hood 6 releasably placed on top of the dispenser head 1 and with a plug member 7 releasably inserted in the dispensing mouth of the dispenser head 1. The hood 6 as well as the plug member 7 must of course be removed before dispensing starts. A container in the form of a cartridge 2 is releasably connected to the lower end of dispenser head 1 by thread means 4. A ring wall 8 extends from the cover wall 9 of the cartridge 2. At the outer circumferential side of said ring wall 8 a thread is provided, which may be brought into engagement with a complementary thread at the inner circumferential surface of the lower end of dispenser head 1. The dispenser head 1 as well as the cartridge 2 are made of extrusion molded plastic material.

An insert 10 made of extruded plastic material positively and non-releaseably attached to the dispenser head 1 and forms a part thereof. This insert 10 defines a cylindrical pump chamber 11, which is orientated parallel to the central axis of the dispenser. A piston 12 is slideably guided in the cylindrical pump chamber 11 and is movable by means of an actuation member in the shape of a push button 13. This push button 13 is connected to the piston via a stem 14 slideably guided in a channel provided in the dispenser head 1. The push button 13 is biased by a helical spring urging the button and piston 12 to the upper end position when there is no external pressure or load on the button. A plate-like disk-shaped closure member 16 is arranged at the lower end of the pump chamber 11 and forms an integral part of the insert 10. The plate-like closure member 16 is integrally connected to the insert 10 by means of two thin flexible connection members or bridges 25 functioning as carrier-and-guidance-arms. The insert 10 together with the plate-like closure member 16 and the carrier arms 25 connecting these parts integrally are manufactured in one step by extrusion molding. FIG. 3 shows another view of plate-like member 16 and the carrier arm connection with insert 10. Since the plate-like closure member 16 is integral with the insert 10, it forms a non-releasable part of the dispenser head 1.

In the cover wall 9 of the cartridge 2, a communication passage generally designated by the arrow 17 is provided. This passage 17 generally has the shape of a circular hole. A basket-like grid 18 is integrally formed and connected with the circumferential edge of the passage 17. This basket-like grid does not obstruct the passage 17 but merely serves the purpose of preventing the instrusion of any particles falling into the interior of the cartridge 2 in situations in which the cartridge is not yet connected with the dispenser head. The basket-like grid 18 is integrally formed with the cartridge 2 in one operational step by extrusion molding. Since the basket-like grid 18 does not contribute to the function of the inlet-check valve, it may be completely missing.

At the upper surface of the cover wall 9 facing the lower end of the dispenser head 1, a ring-shaped protrusion 19 is provided integral with the cartridge 2 and serves as the valve seat of the inlet-check valve. The ring-like protrusion 19 represents an abutment surface onto which the plate-like closure member 16 may come to rest sealingly along the whole circumference of the protrusion in the closed position of the check valve. To enhance sealing abutment of the plate-like closure member 16 to the ring-like valve seat 19, a conical ring-surface is provided at the periphery of the plate-like closure member 16 facing the valve seat and coming to sealing contact with a complementary conical ring-surface at the valve seat 19 in the closed position of the valve. Thus, in the embodiment shown in FIG. 2, one part of the inlet-check valve, namely, the valve seat, is integral with cartridge 2, whereas the other part, the plate-like closure member 16 is connected to the dispenser head 1. The cylindrical pump chamber 11 of the dispenser head is open at its lower end and abuts the upper surface of the cover wall 9 of the cartridge 2 and circumferes or surrounds the inlet-check valve consisting of plate 16 and valve seat 19, when the cartridge 2 and the dispenser head 1 are in their connection position.

The insert 10 of the dispenser head 1 is designed such that there is a passage provided leading from the interior of the pump chamber 11 to an outlet duct leading to the mouth of the dispenser. In the outlet duct of insert 10, a further insert 20 made of extrusion molded plastic material is arranged. Integral with said insert 20 and hinged thereto by a flexible connection web is a flap-like closure member 21 which together with a valve seat in the form of an abutment surface provided in the insert 10 forms an outlet-check valve in the outlet passage of the dispenser head 1.

A follower piston 3 made of extrusion molded plastic material is slideably arranged at the lower end of cartridge 2.

In the embodiment of the dispenser according to the invention shown in FIG. 2, a dummy envelope connected to the dispenser head and surrounding cartridge 2 is not provided. However, it is obvious that a dummy envelope surrounding cartridge 2 could be formed integral with the dispenser head 1 and could be manufactured therewith in one operation by extrusion molding. Thus, the dispenser head 1 shown in FIG. 2 in this respect could obviously be modified to have a dummy envelope as schematically shown in FIG. 1.

In the following, the operation of the dispenser according to FIG. 2 is described. Cartridge 2 filled with pasty material of any appropriate kind to be dispensed by means of dispenser head 1 may be marketed as a separate article independent of dispenser head 1. In this case, dispenser head 1 may be used repetitively in connection with a great number of releasable cartridges 2. In case a filled cartridge 2 is marketed as a separate article, provisions must be made that passage 17 is properly covered so that contaminations of the contents of cartridge 2 cannot occur. This, for instance, may be effected by means of an adhesive label attached to the upper surface of the cover wall 9 of the cartridge and extending over the passage 17. Such a label may be easily and quickly removed from the cartridge when the cartridge is to be attached to the dispenser head 1. Another alternative possibility of protecting the interior of cartridge 2 from contamination coming from outside is to attach a screw cap to the top of the cartridge 2 utilizing the thread 4 at the outer cylindrical face of the ring wall 8. Such a screw cap can be easily and quickly removed when the cartridge 2 is to be attached to the dispenser head 1.

When the cartridge 2 is attached to the dispenser head 1, a depression of button 13 will push piston 12 downwards, thereby reducing the volume of pump chamber 11. During this action, the plate-like closure member 16 of the inlet-check valve will sealingly abut the valve seat 19 around the passage 17, so that the inlet valve is closed. On the other hand, the reduction of the volume of the pump chamber 11 will cause flap 21 of the outlet-check valve to open the outlet passage, so that in case material is already present in the pump chamber, said material will be forced through the outlet duct towards the dispensing mouth and will leave the dispenser head there (presuming that hood 6 and plug 7 have been removed beforehand). If, thereafter, the external pressure on button 13 is released, spring 15 will urge the button back into its uppermost position and will therefore also retract piston 12 into its uppermost position in the pump chamber. By this retraction of the piston 12, the volume of the pump chamber 11 is increased and a reduction of pressure in the pump chamber occurs which causes flap 21 to come to its closing position, thus closing the outlet-check valve and at the same time causing plate 16 to be lifted essentially parallel to the cover wall guided by the flexing carrier arms to open the communication passage 17 between the interior of the cartridge 2 and the pump chamber 11. Due to the pressure difference in the pump chamber 11 and the external pressure, the follower piston 3 at the lower end of the cartridge 2 will be pushed upwards by the external atmospheric pressure, so that material is forced through passage 17 into the pump chamber 11. As soon as the button 13 is now depressed again under external action, piston 12 will be moved downwards again, plate 16 will close the inlet-check valve and flap 21 will move to its opening position, so that the material contained in pump chamber 11 will be forced out through the outlet duct and will be dispensed through the mouth of the dispensing head 1.

I claim:

1. A dispenser for paste-like products comprising:

a dispensing head which includes a pumping device with a pump chamber, the volume of which chamber may be varied by means of an actuation device manually actuatable form outside the dispensing head, an outlet passage leading from the pump chamber to a dispensing mouth on the dispensing head and means in the outlet passage adapted to prevent backflow of the paste-like material into the pump chamber, a container containing the product to be dispensed, the container being formed as a disposable cartridge and having an upper cover wall with an opening therethrough for admitting the product into the pump chamber, the container having its lower end closed by a follower piston slidable along the interior wall surface thereof under the action of the exterior atmosphere as the product leaves the container, means for releasably connecting the container to the lower end of the dispensing head, and an inlet-check valve for prevention of backflow of paste-like material form the pump chamber to the container through the opening therein, characterized in that the inlet-check valve comprises two parts, namely, a valve seat on the upper cover wall of the container and a closure member non-releasably supported on the dispensing head, said closure member being integrally formed with the dispensing head and comprising a plate-like portion engageable with the valve seat and flexible connection members connected between the plate-like portion and the dispensing head.

2. A dispenser according to claim 1 wherein the means in the outlet passage in the dispensing head further comprises an outlet-check valve in the outlet passage to prevent backflow into the pump chamber.

3. A dispenser according to claim 2 wherein the actuation device comprises a piston slidably mounted in the pump chamber and an actuation member for moving the piston.

4. A dispenser according to claim 3 wherein the pump chamber is open at its lower end and wherein the lower end of the portion of the pumping device defining the pump chamber abuts the cover wall of the container and surrounds the inlet-check valve when the container is connected to the dispensing head.

5. A dispenser according to claim 1 wherein the pump chamber is open at its lower end and wherein the lower end of the portion of the pumping device defining the pump chamber abuts the cover wall of the container and surrounds the inlet-check valve when the container is connected to the dispensing head.

6. A dispenser according to claim 1 or 2 or 3 or 4 wherein the closure member comprises a plate-like portion.

7. A dispenser according to claim 1 or 2 or 3 or 4 or 5 wherein the dispensing head is adapted to have containers of different shapes connected thereto.

8. A dispenser according to claim 6, wherein the dispensing head is adapted to have containers of different shapes connected thereto.

9. A dispenser according to claim 1 or 2 or 3 or 4 or 5 wherein the dispensing head comprises a dummy envelope for surrounding the container.

10. A dispenser according to claim 6 wherein the dispensing head comprises a dummy envelope for surrounding the container.

11. A dispenser for paste-like products comprising:

a dispensing head which includes a pumping device with a pump chamber, the volume of which chamber may be varied by means of an actuation device manually actuatable from outside the dispensing head, an outlet passage leading from the pump chamber to a dispensing mouth on the dispensing head and means in the outlet passage adapted to prevent backflow of the paste-like material into the pump chamber, a container containing the product to be dispensed, the container being formed as a disposable cartridge and having an upper cover wall with an opening therethrough for admitting the product into the pump chamber, the container having its lower end closed by a follower piston slidable along the interior wall surface thereof under the action of the exterior atmosphere as the product leaves the container, means for releasably connecting the container to the lower end of the dispensing head, and an inlet-check valve for prevention of backflow of paste-like material from the pump chamber to the container through the opening therein, characterized in that the inlet-check valve comprises two parts, namely, a valve seat on the upper cover wall of the container and a closure member on the dispensing head, said closure member being integrally formed with the dispensing head and comprising a plate-like portion engageable with the valve seat, and flexible connection members connected between the plate-like portion and the dispensing head.

12. A dispenser according to claim 11 wherein the dispensing head is adapted to have containers of different shapes connected thereto.

13. A dispenser according to claim 11 or 12 wherein the dispensing head comprises a dummy envelope for surrounding the container.

14. A dispenser for paste-like products comprising:

a dispensing head which includes a pumping device with a pump chamber open at its lower end, the volume of which chamber may be varied by means of an actuation device manually actuatable from outside the dispensing head, the actuation device comprising a piston slidably mounted in the pump chamber and an actuation member for moving the piston, an outlet passage leading from the pump chamber to a dispensing mouth on the dispensing head and means in the outlet passage adapted to prevent backflow of the paste-like material into the pump chamber, a container containing the product to be dispensed, the container being formed as a disposable cartridge and having an upper cover wall with an opening therethrough for admitting the product into the pump chamber, the container having its lower end closed by a follower piston slidable along the interior wall surface thereof under the action of the exterior atmosphere as the product leaves the container, means for releasably connecting the container to the lower end of the dispensing head, and an inlet-check valve for prevention of backflow of paste-like material from the pump chamber to the container through the opening therein, characterized in that the inlet-check valve comprises two parts, namely, a valve seat on the upper cover wall of the container and a closure member on the dispensing head, said closure member being integrally formed with the dispensing head and comprising a plate-like portion engageable with the valve seat, and flexible connection members connected between the plate-like portion and the dispensing head, and wherein the open lower end of the portion of the pumping device defining the pump chamber abuts the cover wall of the container and surrounds the inlet-check valve when the container is connected to the dispensing head.

15. A dispenser according to claim 14 wherein the dispensing head is adapted to have containers of different shapes connected thereto.

16. A dispenser according to claim 14 or 15 wherein the dispensing head comprises a dummy envelope for surrounding the container.

* * * * *